US010900495B2

(12) United States Patent
Mikkelsen

(10) Patent No.: US 10,900,495 B2
(45) Date of Patent: Jan. 26, 2021

(54) MULTISTAGE PUMP

(71) Applicant: GRUNDFOS HOLDING A/S, Bjerringbro (DK)

(72) Inventor: Steen Mikkelsen, Bjerringbro (DK)

(73) Assignee: GRUNDFOS HOLDING A/S, Bjerringbro (DK)

( * ) Notice: Subject to any disclaimer, the term of this patent is extended or adjusted under 35 U.S.C. 154(b) by 208 days.

(21) Appl. No.: 15/367,436

(22) Filed: Dec. 2, 2016

(65) Prior Publication Data

US 2017/0159672 A1 Jun. 8, 2017

(30) Foreign Application Priority Data

Dec. 2, 2015 (EP) ..... 15197535

(51) Int. Cl.

| | |
|---|---|
| ***F04D 29/42*** | (2006.01) |
| ***F04D 29/02*** | (2006.01) |
| ***F04D 1/06*** | (2006.01) |
| ***F04D 29/62*** | (2006.01) |

(52) U.S. Cl.

CPC ..... *F04D 29/4266* (2013.01); *F04D 1/06* (2013.01); *F04D 1/063* (2013.01); *F04D 29/026* (2013.01); *F04D 29/4293* (2013.01); *F04D 29/628* (2013.01); *F05D 2230/54* (2013.01); *F05D 2250/51* (2013.01); *F05D 2250/52* (2013.01); *F05D 2300/171* (2013.01)

(58) Field of Classification Search

CPC .... F04D 29/4266; F04D 1/06; F04D 29/4293; F04D 29/4253; F04D 1/04; F01D 1/06; F01D 1/063

USPC ..... 415/182.1

See application file for complete search history.

(56) References Cited

U.S. PATENT DOCUMENTS

| | | | | |
|---|---|---|---|---|
| 5,030,061 A | | 7/1991 | Meissgeier | |
| 5,385,444 A | * | 1/1995 | Kobayashi | F04D 1/006 415/182.1 |
| 5,961,301 A | * | 10/1999 | Wasserman | F04D 1/06 417/365 |
| 7,648,337 B2 | * | 1/2010 | Kuroiwa | F04D 1/063 415/199.1 |
| 2009/0274555 A1 | * | 11/2009 | Ouwehand | F04D 1/06 415/203 |

FOREIGN PATENT DOCUMENTS

| | | | | |
|---|---|---|---|---|
| CN | 103 807 179 A | | 5/2014 | |
| WO | WO-2008071592 A1 | * | 6/2008 | F04D 1/063 |

* cited by examiner

*Primary Examiner* — Courtney D Heinle
*Assistant Examiner* — Andrew Thanh Bui
(74) *Attorney, Agent, or Firm* — McGlew and Tuttle, P.C.

(57) ABSTRACT

The invention relates to a multistage pump (1), including a pump body (4), at a lower end of which a base element (2) is arranged, and at an upper end of which a head element (3) is arranged. At least the base element (2) is made from sheet steel and has an inlet port (5) and an outlet port (16). The inlet port (5) and the outlet port (16) are mechanically connected to each other by a pipe (6) running through the base element (2).

20 Claims, 6 Drawing Sheets

Fig.3
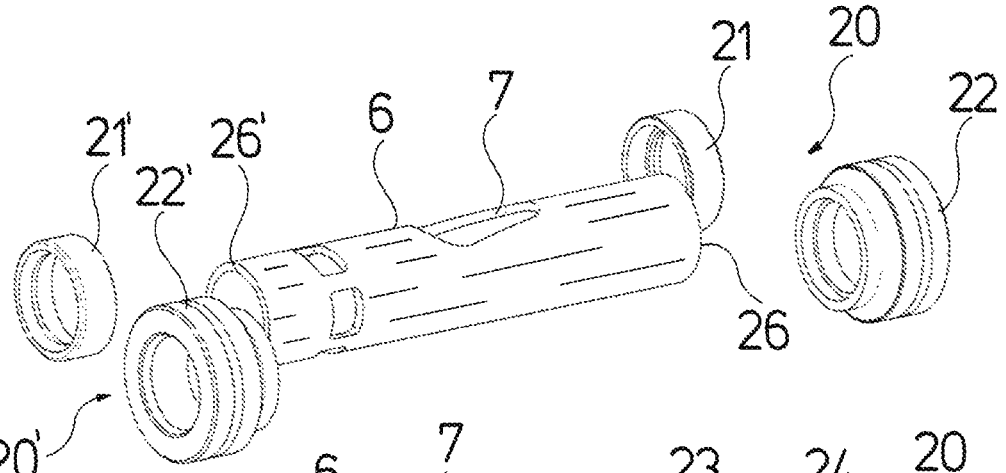
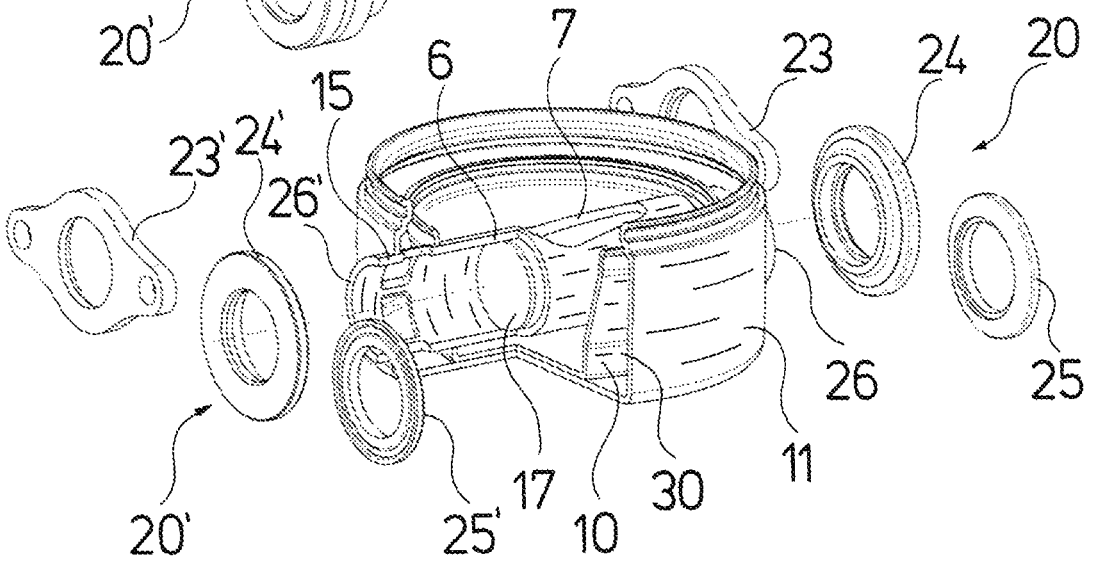
Fig.4

MULTISTAGE PUMP

CROSS REFERENCE TO RELATED APPLICATIONS

This application claims the benefit of priority under 35 U.S.C. § 119 of European Application 15 197 535.6 filed Dec. 2, 2015, the entire contents of which are incorporated herein by reference.

FIELD OF THE INVENTION

The present invention relates to a multistage pump comprising a pump body at a lower end of which a base element is arranged, and at an upper end of which a head element is arranged, at least the base element being made from sheet steel and having an inlet port and an outlet port.

BACKGROUND OF THE INVENTION

Multistage rotary pumps known in prior art basically comprise a base element, a pump body, and a head element as main elements. The base element is provided with an inlet port equipped with a suction connecting piece through which a fluid enters the pump, and an outlet port equipped with a pressure connecting piece through which the fluid, after having been passed through a plurality of pump stages arranged one above or adjacent to the other in the pump body, is discharged from the pump again.

In prior art, the base element of such multistage pumps usually is made from cast iron in order to provide sufficient rigidity and stability to the pump. However, the use of cast iron for the base element, on the one hand, imparts a certain weight to the pump and, on the other hand, also renders the pump expensive due to high material costs.

In order to provide a less expensive and light-weight pump, solutions are known from prior art using sheet metal for the base element instead of cast iron. However, when replacing cast iron by sheet metal in the base element, the pump inevitably will suffer from stability problems.

SUMMARY OF THE INVENTION

Therefore, it is an object of the present invention to provide a light-weight multistage pump with sufficient stability and robustness.

According to the invention, a multistage pump is provided, comprising a pump body, at a lower end of which a base element is arranged, and at an upper end of which a head element is arranged, at least the base element being made from sheet steel and having an inlet port and an outlet port, wherein the inlet port and the outlet port are mechanically connected to each other by an elongate carrier running through the base element. This elongate carrier is a pipe with efficient strength and which is mechanically connected for example by welding. This carrier enforces stability of the base element especially in the region of the inlet port and the outlet port where pipes are connected and where mechanical forces may be high. The main idea of this invention is to use an elongate carrier in form of a pipe running across the base element which on the one hand gives high stability to the base element and on the other hand to the inlet port and the outlet port. The pipe gives high stability in all directions across this pipe. The main advantage to use a pipe as an elongate carrier is that this is not only used to enforce stability of the base element but also to create the channels leading to the inlet and the outlet ports.

By this inventive configuration, a light-weight pump can be provided which nevertheless has sufficient stability and robustness due to the mechanical connection of the inlet port and outlet port within the base element. This pipe running through the base element and connecting the inlet port and the outlet port gives a high stability of the base element and can be used as channels from the inlet port and to the outlet port. Moreover, the multistage pump according to the present invention can be produced at low costs compared to pumps comprising a cast iron base element.

According to a preferred embodiment of the invention, a suction connecting piece is fitted at a first end of the pipe located at the inlet port, and a pressure connecting piece is fitted at a second end of the pipe located at the outlet port. This makes it easy to construct inlet port and the outlet port. As these connecting pieces are fitted at the ends of the pipe it is easy to equip the multistage pump with different sorts of connecting pieces as they are used in different countries. Moreover, a good sealing effect can be achieved by welding the connecting pieces respectively to the pipe.

According to a further preferred embodiment, the base element comprises a base cup which forms a cylindrical outer circumferential wall of the base element. Such a base cup can be produced by metal forming from a sheet metal plate and gives high stability especially in combination with the pipe running through this base cup.

Further, the pipe may be connected fixedly, in particular, by welding, to the base element, in particular, to the base cup, thereby further enhancing the mechanical strength of the base element and thus, the entire multistage pump. This material connection provides for further improvements as to stability and mechanical strength of the pump.

According to still a further preferred embodiment, the pump further comprises an inner pipe for separating fluid entering the pump at the inlet port having a first pressure and fluid being discharged from the pump at the outlet port having a second pressure, the inner pipe comprising a number of stackable pipe elements. The inner pipe also serves for accommodating or enclosing the pump stack comprising a plurality of pump stages arranged one above the other, wherein it is especially preferred, if each element of the inner pipe respectively surrounds one pump stage. The stackable inner pipe elements preferably are also connected to each other fixedly.

It also is preferable, if the inlet port and the outlet port are arranged at opposing sides at the circumference of the base element.

Moreover, the pipe connecting the inlet port and the outlet port may be a straight pipe. Preferably this pipe has a circular cross section. This design of the pipe is simple and thus, may be produced at low costs. It guarantees high stability.

According to a further preferred embodiment, at least one first hole is formed in the pipe for providing a passage for the fluid entering the pump through the inlet port to the pump body, in particular, so as to pass through a plurality of pump stages arranged within the pump body.

Also, at least one second hole may be formed in the pipe adjacent to the outlet port for providing a passage from the inner pipe to the outlet port for the fluid which has passed through the at least one pump stage. With respect to the at least one first hole and at least one second hole it is noted that with respect to the pump efficiency, it is preferable to respectively only provide one first and several second holes in order to minimize turbulences in the fluid entering and leaving the base element.

A disc-shaped member having substantially the same diameter as the inner diameter of the pipe may be arranged within the pipe, so as to seal the fluid entering the pump through the inlet port from the fluid being discharged from the pump through the outlet port. This disc-shaped member can be also produced from sheet metal and welded to the pipe.

Preferably, the disc-shaped member is arranged between the first hole and the at least one second hole of the pipe. The provision of the disc-shaped member between the first and second holes of the pipe serves for sealing the high pressure fluid flow from the low pressure fluid flow in the pipe between the inlet and outlet ports.

According to a further preferred embodiment, the pipe runs through a suction chamber, in particular, through its center, formed within the base element. This configuration offers further stability enhancements.

Moreover, it is advantageous, if the pipe runs through an annular space formed between the inner pipe and the base cup. Preferably the pipe running through the base element is fixed to the inner pipe by expanding and to the base cup by welding.

Preferably, the base cup is connected at its upper end to a cylindrical sleeve of the pump body, which is also formed from sheet metal. Between this cylindrical sleeve and the inner pipe there is formed a ring channel which feeds back the fluid from the last pump stage to the outlet port. For entering the fluid from this ring channel into the elongate pipe across the base element there are preferably formed several holes along the circumference of the pipe.

Further details and features of the invention as well as concrete embodiments of the invention can be derived from the following description in connection with the drawing The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

In the drawings:

FIG. 3 shows an exploded view of a pipe and connecting pieces for a pump according to an embodiment of the invention;

FIG. 4 shows a base element including a pipe and connecting pieces for a pump according to an embodiment of the invention;

DESCRIPTION OF THE PREFERRED EMBODIMENTS

Figure 1:
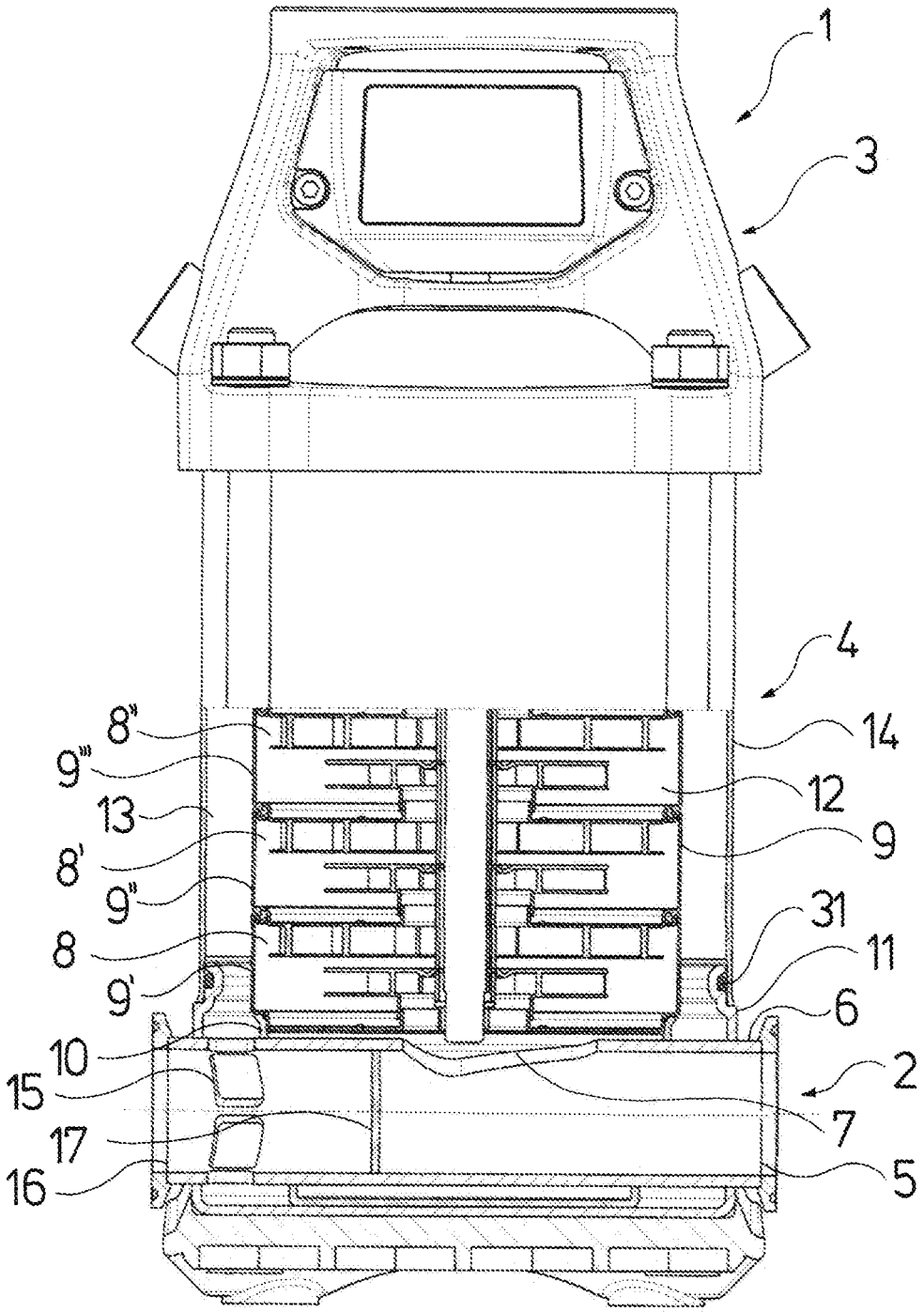
FIG. 1 shows a multistage pump according to a preferred embodiment of the invention, whereby the lower half of the pump is shown in sectional view and the upper half in regular side view.

Referring to the drawings, FIG. 1 shows a multistage pump 1 according to a preferred embodiment of the invention, whereby the lower half of the pump 1 is shown in sectional view and the upper half in regular side view. As can be seen, basically the pump 1 can be subdivided in three sections, namely, the lowermost part of the pump 1 is formed by the base element 2, the uppermost part of the pump 1 is formed by a head element 3, and in between the base element 2 and the head element 3, there is arranged a pump body 4. When the pump 1 is activated, fluid, or in particular, water, enters the pump 1 through an inlet port 5 in the base element 2, then passes through a pipe 6 so as to enter through a first hole 7 of the pipe 6 the pump body 4 in which a plurality of pump stages 8, 8', 8", etc. are provided, each having an impeller and an diffuser.

In the pump body 4, the fluid is passed on from stage to stage upwards within a first annular space 12 surrounded by an inner pipe 9 which consists of a plurality of stackable pipe elements 9', 9", 9''', etc., whereby basically each one of the pump stages 8, 8', 8", etc. is surrounded by one of the stackable pipe elements 9', 9", 9''', etc. The stackable inner pipe 9 rests on an inner cup member 10 of the base element 2, which in turn is surrounded by an outer base cup 11 of the base element 2. The fluid, after having been passed through the pump stages 8, 8', 8", etc. in the pump body 4, then reaches the head element 3 of the pump 1 then flows back, e.g., through holes of a bearing ring not shown here, into a second annular space 13 which is formed between a jacket or outer sleeve 14 of the pump body 4 and the inner pipe 9. The outer sleeve 14 is sealingly connected, in particular by means of an O-ring 31, to the outer base cup 11 of the base element 2. When the fluid having passed through the second annular space 13 downwards reaches the base element 2 again, it will be discharged from the pump 2 by first passing through a second hole 15 or a plurality of second holes 15, provided in the circumference of the pipe 6 into the pipe 6 and from there, the fluid leaves the pump 1 again through the outlet port 16 of base element 2.

Figure 2:
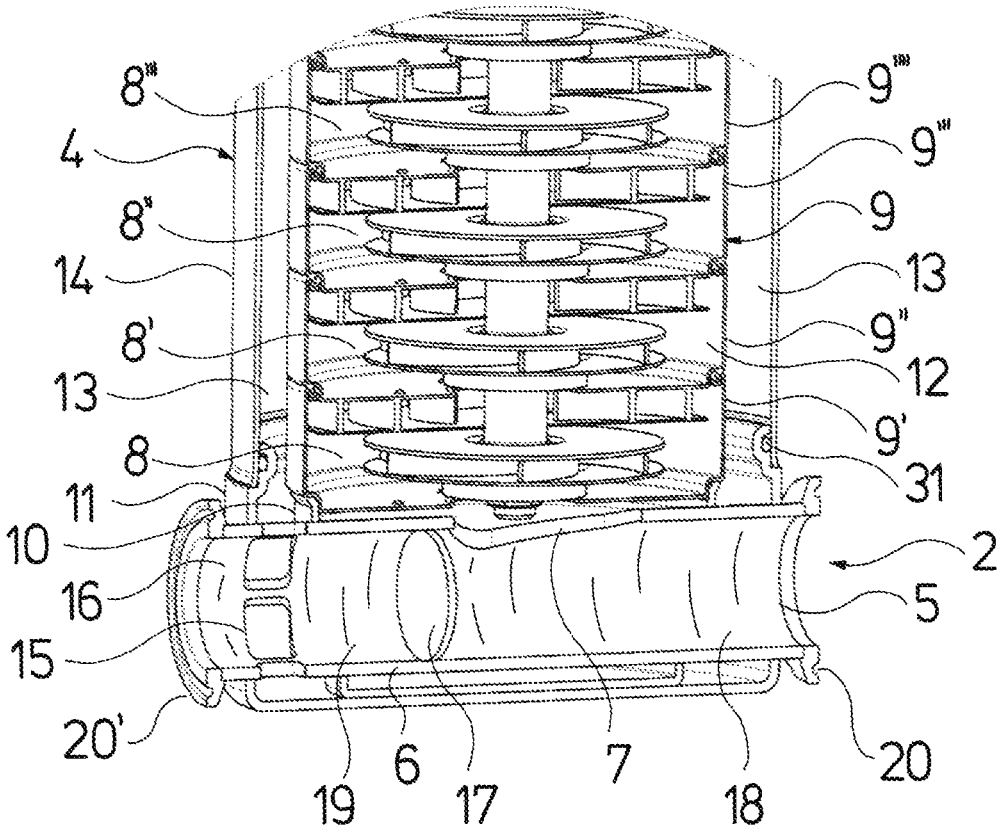
FIG. 2 shows a detail of a lower portion of the multistage pump of FIG. 1 in a cut open perspective view.

FIG. 2 shows a detail of a lower portion of the multistage pump 1 of FIG. 1 in a cut open perspective view. Here, the arrangement of a number of pump stages 8, 8', 8", 8''', etc. can be seen which are arranged one on top of the other, and each of which is surrounded by a respective element 9', 9", 9''', 9'''', etc. of the stackable inner pipe 9. The elements 9', 9", 9''', 9'''', etc. are connected to each other and together form the inner pipe 9. The lowermost member of the stackable inner pipe 9 rests on and is connected to the inner cup member 10 of the base element 2. The outer jacket of the pump 1 in its middle and lower sections is formed by the outer sleeve 14 encasing the pump body 4 with the plurality of pump stages 8, 8', 8", 8''', etc., and the outer base cup 11 of the base element 4.

Further, as already mentioned above, the base element 2 has an inlet port 5 and an outlet port 16 arranged at the opposing side at the circumference of the base cup 11. The inlet port 5 and the outlet port 16 are mechanically connected to each other by the pipe 6 which passes through the annular space 30 formed between the outer base cup 11 and the inner cup member 10 as well as through the interior space of inner cup member 10 itself, forming a suction chamber of the base element 1. Within the pipe 6, there is arranged a disk-shaped member 17 which basically has the same or a just slightly smaller diameter as the inner diameter of the pipe 6 so as to seal a low pressure section 18 on the inlet side of the pipe 6 from a high pressure section 19 at the outlet side of the pipe 6. Further, both ends of the pipe 6 are provided with respective connecting pieces 20, 20' for connecting the pump 1 to respective external inflow and outflow pipes not shown here.

FIG. 3 shows the pipe 6 as well as the respective connecting pieces 20, 20' for a multistage pump 1 according to embodiments of the invention in an exploded view. Each one of the connecting pieces 20, 20' can be formed for example by a sleeve 21, 21' which is substantially cylindrical, or by a stepped sleeve 22, 22'. The connecting pieces 20, 20' to be fitted on the pipe 6 at the suction or inlet side and the pressure or outlet side of the pump 1 are identical and connected to the pipe by welding.

FIG. 4 shows a base element 2 including the pipe 6 and connecting pieces 20, 20' for a pump 1 according further embodiments of the invention. As can be seen here, the connecting piece 20, 20' can consist of, a flange part 23, 23', a ring part 24, 24', or a ring part 25, 25' to be fixedly connected to the respective pipe end 26, 26', for example, by welding. FIGS. 3 and 4 show different examples of connecting pieces 20, 20' which make clear that it is very easy to adapt this pump to any connecting system.

Figure 5:
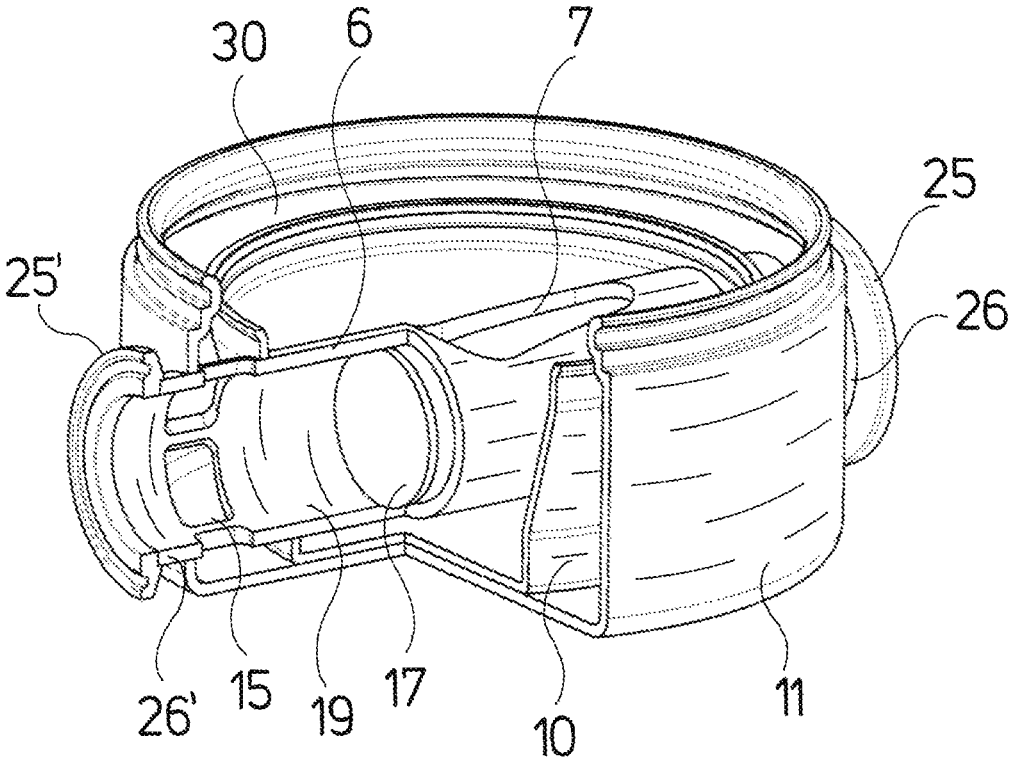
FIG. 5 shows a perspective view of the base element, partially cut open.

FIG. 5 shows a perspective view of the base element 2, partially cut open at the outlet end of the pipe 6 and base cup 11. As can be seen here, the ring part 25, 25' is fixedly connected to the pipe end 26' at the outlet or pressure side of the pump 1 by means of welding. Further, the pipe 6 is connected to the base cup 11 by welding and to the inner cup member 10 by expanding so that sufficient mechanical strength is provided for the base element 2 of the pump 1, since the components of the base element 2, namely, the base cup 11 and the inner cup member 10 are formed from sheet metal. Also, it can be seen that the disc-shaped member 17 is arranged within the pipe 6 between the first hole 7 on the inlet side or low pressure side, and the plurality of second holes 15 on the outlet side or high pressure side so as to sealingly separate the low pressure section 18 from a high pressure section 19.

Figure 6A:
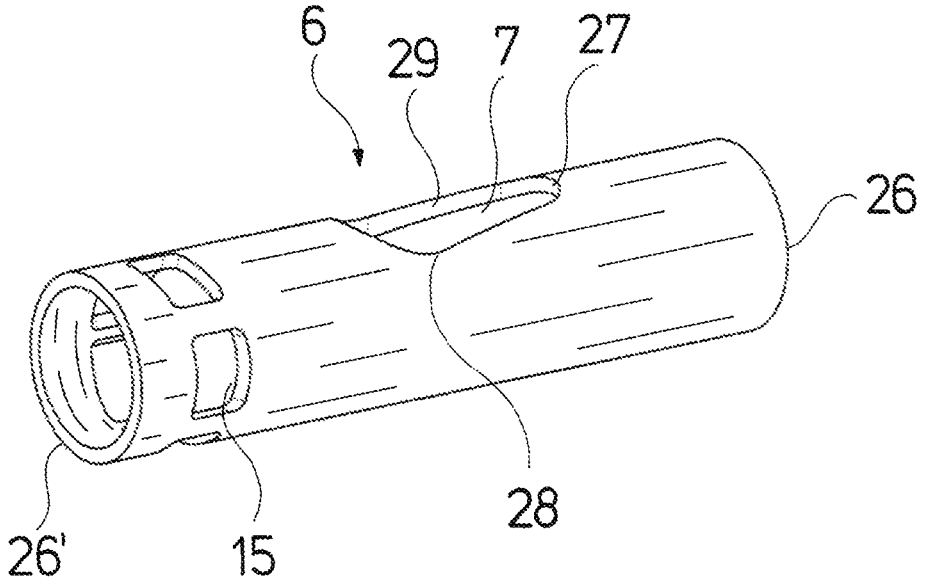
FIG. 6A shows a perspective view of the pipe of the multistage pump shown in FIG. 1.
Figure 6B:
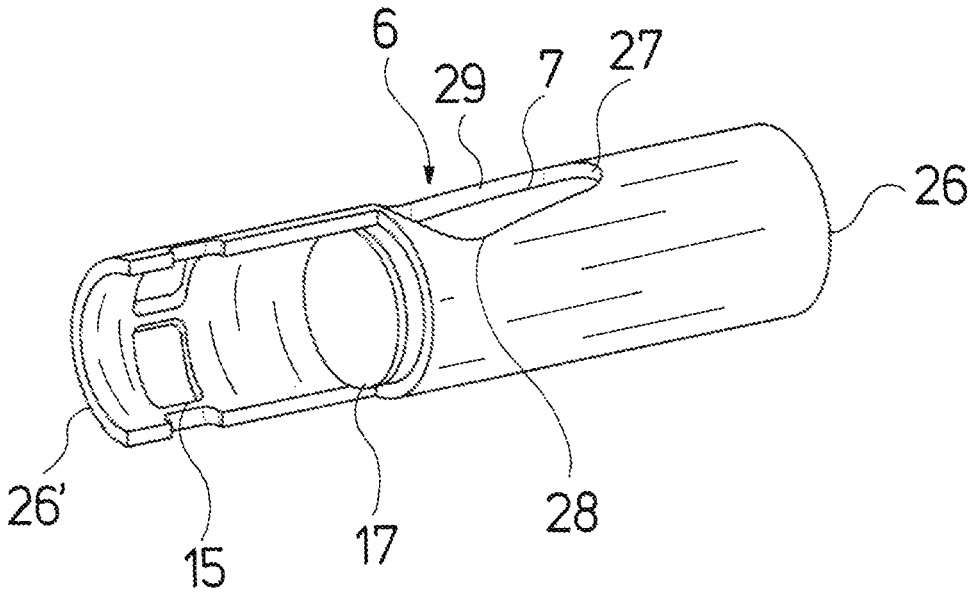
FIG. 6B shows a perspective view of the pipe of the multistage pump shown in FIG. 1.

FIG. 6A and FIG. 6B respectively show perspective views of the pipe 6 of the multistage pump shown in FIG. 1, whereby FIG. 6B shows the outlet side of the pipe 6 or high pressure section 19 with the front part of the pipe 6 cut out so that the arrangement of the disc-shaped member 17 between the first hole 7 and the plurality of second holes 15 can be seen. Further, it can be seen that the first hole is arranged at an upper or top part of the pipe 6 which, when assembled in the base element 2 and to the pump 1 is directed towards the pump body 4 or the first annular space 12 in which the pump stages 8, 8', 8", etc. are arranged. The first hole 7 has an elongated shape with rounded corners 27 and substantially V-shaped recesses 28 at at least one of the lateral edges 29 of the first hole 7. This hole 7 is part of the suction mouth of the first pumpstage. The second holes 15 are arranged symmetrically around the outer circumference of the pipe 6 at the outlet end and are substantially rectangular, whereby all second holes 15 are formed identically and spaced apart from each other at equal distances.

The multistage pump 1 being provided with the pipe 6 arranged within the outer base 11 of the base member 2 acts as a stiffening element and provides for sufficient strength when using sheet metal as material for the member of the base member 2.

While specific embodiments of the invention have been shown and described in detail to illustrate the application of the principles of the invention, it will be understood that the invention may be embodied otherwise without departing from such principles.

APPENDIX

Reference Numerals

1 multistage pump
2 base element
3 head element
4 pump body
5 inlet port
6 pipe
7 first hole
8, 8', 8", . . . pump stages
9 inner pipe
9', 9", 9'", . . . elements of inner pipe
10 inner cap member
11 outer base cup
12 first annular space
13 second annular space
14 outer sleeve
15 second holes
16 outlet port
17 disc-shaped member
18 low pressure section
19 high pressure section
20, 20' connecting pieces
21, 21' inner sleeve
22, 22' outer sleeve
23, 23' outer flange part
24, 24' intermediate ring part
25, 25' inner ring part
26, 26' pipe end
27 rounded corner
28 recess
29 lateral edge
30 third annular space
31 O-ring

What is claimed is:

1. A multistage pump, comprising:

a base element;

a head element;

a pump body with a lower end and an upper end, the base element being arranged at the lower end and the head element being arranged at the upper end, wherein at least the base element is made from sheet steel, the pump body comprising a pump body longitudinal axis; and an elongate carrier running through the base element, the elongate carrier being a different component from the base element made from sheet steel, wherein the elongate carrier is a one-piece pipe which is interrupted by a wall, wherein an inlet port and an outlet port of the multistage pump are formed by the one-piece pipe, the one-piece pipe comprising a one-piece pipe longitudinal axis, the one-piece pipe longitudinal axis being non-parallel to the pump body longitudinal axis.

2. A multistage pump according to claim 1, wherein a suction connecting piece is fitted at a first end of the pipe located at the inlet port, and a pressure connecting piece is fitted at a second end of the pipe located at the outlet port, the one-piece pipe comprising a first pipe extent and a second pipe extent, the first pipe extent and one side of the wall defining an inlet flow channel in fluid communication with the inlet port, the second pipe extent and another side of the wall defining an outlet flow channel in fluid communication with the outlet port.

3. A multistage pump according to claim 1, wherein the base element comprises a base cup which forms a cylindrical outer circumferential wall of the base element, the cylindrical outer circumferential wall comprising a first cylindrical outer circumferential wall portion adjacent to the outlet port and a second cylindrical outer circumferential wall portion adjacent to the inlet port, the pipe being in contact with the first cylindrical outer circumferential wall portion and the second cylindrical outer circumferential wall portion, the base element further comprising an inner member, the inner member comprising a first inner member portion and a second inner member portion, the first inner member portion being located opposite the inlet port, the second inner member portion being located opposite the outlet port, the pipe being in contact with the first inner member portion and the second inner member portion.

4. A multistage pump according to claim 2, wherein the suction connecting piece and the pressure connecting piece are respectively connected fixedly by welding to the pipe.

5. A multistage pump according to claim 3, wherein the pipe is connected fixedly, by expanding and/or welding, to the base cup.

6. A multistage pump according to claim 2, wherein the pipe is connected fixedly, by expanding and/or welding, to the base cup, the one-piece pipe comprising an outer surface extending continuously from the inlet port to the outlet port, the inlet port comprising an inlet port fluid contact surface for contacting fluid entering the inlet port and the outlet port comprising an outlet port fluid contact surface for contacting the fluid exiting the outlet port.

7. A multistage pump according to claim 1, further comprising an inner pipe for separating fluid entering the pump at the inlet port having a first pressure and fluid being discharged from the pump at the outlet port having a second pressure, the inner pipe comprising a plurality of stacked pipe elements.

8. A multistage pump according to claim 1, wherein the inlet port and the outlet port are arranged at opposing sides at a circumference of the base element.

9. A multistage pump according to claim 1, wherein the pipe connecting the inlet port and the outlet port is a straight pipe with a circular cross section.

10. A multistage pump according to claim 7, wherein at least a first hole is formed in the pipe forming the elongate carrier for providing a passage for the fluid entering the pump through the inlet port to the pump body, for passing through a plurality of pump stages arranged within the pump body.

11. A multistage pump according to claim 10, wherein at least one second hole is formed in the pipe adjacent to the outlet port for providing a passage from the inner pipe to the outlet port for the fluid which has passed through at least one of the plurality of pump stages.

12. A multistage pump according to claim 7, wherein the wall comprises a disc-shaped member having substantially a same diameter as an inner diameter of the pipe forming the elongate carrier is arranged within the pipe forming the elongate carrier, so as to seal the fluid entering the pump through the inlet port from the fluid being discharged from the pump through the outlet port.

13. A multistage pump according to claim 12, wherein:

at least a first hole is formed in the pipe for providing a passage for the fluid entering the pump through the inlet port to the pump body, for passing the fluid through a plurality of pump stages arranged within the pump body;

at least one second hole is formed in the pipe adjacent to the outlet port for providing a passage from the inner pipe to the outlet port for the fluid which has passed through the at least one of the plurality of pump stages; and the disc-shaped member is arranged between the first hole and the at least one second hole of the pipe.

14. A multistage pump according to claim 1, wherein the pipe runs through a suction chamber center, formed within the base element.

15. A multistage pump according to claim 3, wherein the pipe runs through an annular space formed between the inner member and the base cup.

16. A multistage pump according to claim 3, wherein an upper end of the base cup is connected to a cylindrical outer sleeve of the pump body.

17. A multistage pump according to claim 1, wherein the base element comprises a base element interior space, at least a portion of the pipe being located in the base element interior space.

18. A multistage pump, comprising:

a multistage pump structure comprising:

abase element comprising an inner base element surface, the inner base element surface defining at least a portion of a base element interior space;

a head element;

a pump body with a lower end and an upper end, the base element being arranged at the lower end and the head element being arranged at the upper end, wherein at least the base element is made from sheet steel, the pump body comprising a pump body longitudinal axis; and a single, one-piece elongate carrier structure comprising a single, one-piece elongate carrier longitudinal axis, at least a portion of the elongate carrier structure extending through the base element interior space in a direction transverse to the pump body longitudinal axis, the single, one-piece elongate carrier structure defining an inlet of the multistage pump structure for receiving a flow of fluid and the single, one-piece elongate carrier structure defining an outlet of the multistage pump structure for discharging the flow of fluid.

19. A multistage pump according to claim 18, wherein the elongate carrier structure is formed via a pipe, wherein the pipe extends from one side of the base element through the base element interior space to another side of the base element, the base element comprising a first opening and a second opening, the single, one-piece elongate carrier extending through the first opening and the second opening, the inlet comprising an inlet inner surface configured to be in direct contact with the fluid, the outlet comprising an outlet inner surface configured to be in direct contact with the fluid.

20. A multistage pump according to claim 19, wherein the base element comprises a first base element portion and a second base element portion, the first base element portion being located radially inward of the second base element portion with respect to a longitudinal axis of the base element, the pipe supporting the first base element portion at a position adjacent to the inlet port and at another position adjacent to the outlet port, the pipe supporting the second base element portion at another position located opposite the inlet port and at a position located opposite the outlet port, wherein at least a portion of the pipe extends in an interior space defined by the second base element portion, the portion of the pipe being located at a spaced location from the base element, the single, one-piece elongate carrier longitudinal axis being perpendicular to the pump body longitudinal axis.

* * * * *